United States Patent [19]

Castellano et al.

[11] Patent Number: 4,553,468

[45] Date of Patent: Nov. 19, 1985

[54] REPEATING FIREARM TRIGGER MECHANISM

[75] Inventors: Thomas P. Castellano, Los Angeles, Calif.; Nathan Mandel, 20283 Lorenzana Ave., Woodland Hills, Calif. 91364

[73] Assignee: Nathan Mandel, Woodland Hills, Calif.

[21] Appl. No.: 532,710

[22] Filed: Sep. 16, 1983

Related U.S. Application Data

[63] Continuation-in-part of Ser. No. 434,564, Oct. 15, 1982, Pat. No. 4,421,009.

[51] Int. Cl.[4] ..... F41D 11/02

[52] U.S. Cl. ..... 89/140; 89/149

[58] Field of Search ..... 89/140, 149

[56] References Cited

U.S. PATENT DOCUMENTS

| | | | |
|---|---|---|---|
| 1,484,163 | 2/1924 | Vincon | 89/149 |
| 2,826,121 | 3/1958 | Dodich | 89/140 |
| 4,421,009 | 12/1983 | Castellano et al. | 89/140 |

*Primary Examiner*—Stephen C. Bentley

*Attorney, Agent, or Firm*—Freilich, Hornbaker, Rosen & Fernandez

[57] ABSTRACT

A machinegun pistol is described, which can be reliably switched between semi and full automatic modes by an operator holding the gun in a natural two-hand grip. The gun includes a bolt (20, FIG. 1) and a firing pin device 22 that each slide longitudinally, a trigger assembly with a primary sear (28) that is depressed by the trigger for semiautomatic operation, and an auto control member (34) that can be depressed to switch to full automatic operation. When the control member is depressed, it connects a secondary sear (36) with the primary sear. The bolt carries a cam (40) that can depress the secondary sear (36) when the bolt moves forward, to thereby repeatedly depress the primary sear (28) when the two sears are connected during automatic operation. The control member (34) is operated by depressing it into the frame, to avoid errors in the heat of battle. The depressable control member (34, FIG. 2) lies on the right side of the gun, forward of the trigger (14), so that when the left hand (L) is used to also hold the gun, the fingers of the left hand can feel and depress the control member.

8 Claims, 11 Drawing Figures

FIG. 10
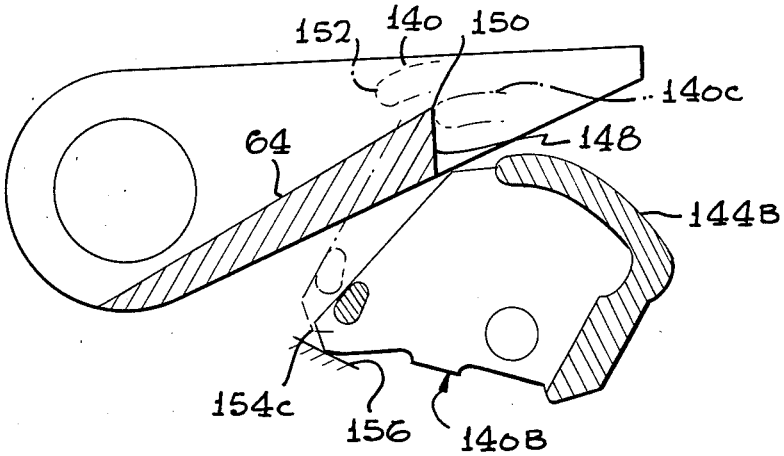
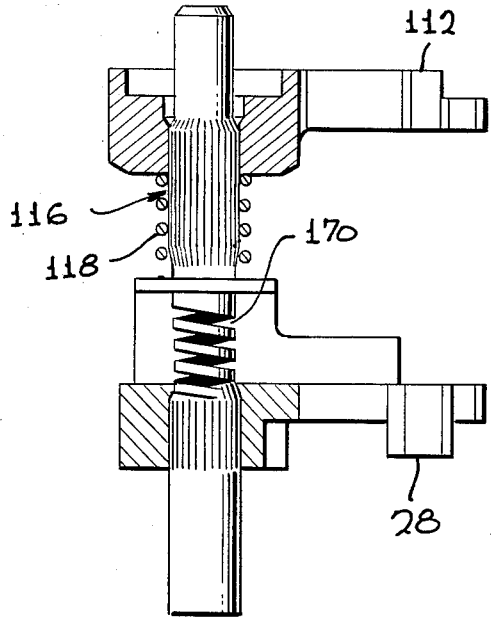
FIG. 11

REPEATING FIREARM TRIGGER MECHANISM

CROSS-REFERENCE

This is a continuation-in-part of U.S. patent application Ser. No. 434,564 filed Oct. 15, 1982 now U.S. Pat. No. 4,421,009 for Repeating Firearm.

BACKGROUND OF THE INVENTION

Machine guns are typically switched between semiautomatic and full automatic modes of operation by operating a selector switch. It is often difficult for the operator to remember the proper direction of movement to switch between the full and semiautomatic modes, especially in the heat of battle, or if the gun is climbing out of control during full automatic operation. Reliability of operation is, of course, of great importance. Machine gun mechanisms often include a sear that is repeatedly hit during full automatic operation, and if that sear breaks, the gun cannot operate at all. A machine gun which could be switched between full and semiautomatic operation with a minimum possibility of error during a variety of stressful conditions, and which operated with high reliability, would be of considerable value.

SUMMARY OF THE INVENTION

In accordance with one embodiment of the present invention, a repeating firearm is provided which facilitates reliable use by the operator and which operates with high reliability. The firearm includes a bolt and a firing pin device that each slide along the length of the gun, a trigger assembly that includes a sear mechanism that can release the firing device, and an auto control for operating the sear mechanism in either full or semiautomatic modes of operation. The auto control can include a member lying outside the gun frame, and moveable to a full automatic mode by depressing the member towards the gun frame. This avoids uncertainty as to the direction in which the control must be moved. The control member can be placed on the right side of the gun slightly forward of the trigger, so when a person grasps a hand grip in his right hand while his left hand holds the gun nestled between the thumb and forefinger of the left hand, the fingers of the left hand can feel and depress the control member.

The trigger assembly can include a primary sear that is depressed to release the firing pin device, while the auto control for selecting the mode of operation can include a secondary sear. The secondary sear can be depressed during forward motion of the bolt. When the control member is operated to the full automatic mode, the secondary sear is in the path of the bolt and the sears are connected together, so every time the bolt moves forward and depresses the secondary sear, the primary sear is also depressed to release the firing pin device, to thereby operate the gun in the full automatic mode. If the sears are disconnected, or the secondary sear is moved out of the path of the bolt, the gun will stop firing in the full automatic mode.

The novel features of the invention are set forth with particularity in the appended claims. The invention will be best understood from the following description when read in conjunction with the accompanying drawings.

BRIEF DESCRIPTION OF THE DRAWINGS

FIG. 10 is a view simialr to FIG. 9, showing the mechanism at a later time in its operation.

FIG. 11 is a plan view of a portion of the firearm of FIG. 8.

DESCRIPTION OF THE PREFERRED EMBODIMENTS

Figure 1:
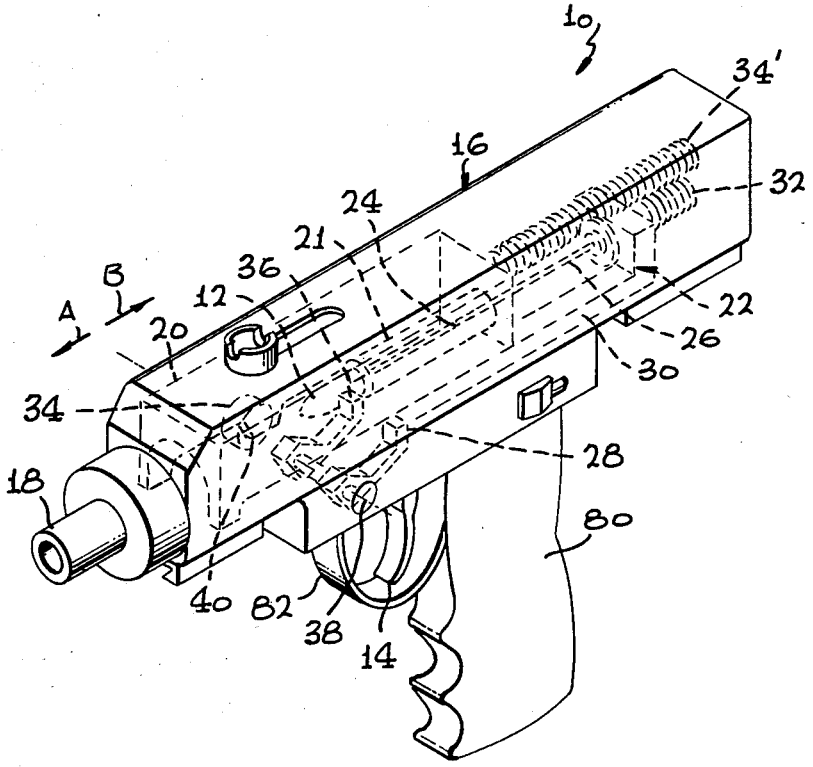
FIG. 1 is a left side perspective view of a repeating firearm constructed in accordance with one embodiment of the present invention, with some of the mechanisms shown in hidden lines.

FIG. 1 illustrates a repeating firearm or machinegun 10 which can operate in either a semiautomatic mode wherein a single cartridge 12 is fired every time a trigger is pulled, or in a full automatic mode wherein cartridges are repeatedly fired so long as the trigger 14 is maintained in a pulled or rearward position. The gun includes a frame 16, and a barrel 18 mounted on the frame and having a rearward end into which the cartridge 12 is inserted. A bolt 20 can slide in the length direction of the frame, in forward and rearward direction A, B, to insert or chamber a cartridge in the gun barrel and to remove the cartridge casing. A firing pin device 22 can also slide within the frame so the tip 24 of a firing pin 26 can strike the cartridge 12 to fire it.

FIG. 1 shows the gun in a cocked position, with the bolt 20 forward with a chambering portion 21 backing up the chambered cartridge 12, but with the firing device 22 held at a rearward position by reason of a primary sear 28 lying in the path of an extension rod 30 of the firing device. When the operator pulls the trigger 14, the primary sear 28 is briefly depressed, which allows the firing device to be thrust forward by its spring 32, until the tip 24 of the firing pin hits the rear of the cartridge 12 to fire it. The recoil from the fired cartridge causes the bolt 20 to move rearwardly and compress a bolt spring 34'. The rearwardly moving bolt moves the firing device 22 rearwardly, to a position at which the front of the extension rod 30 moves behind the primary sear 28, so the sear springs up again to lie in the path of the extension rod. The bolt removes a spent cartridge during rearward movement, and the bolt is then pushed forward by the spring 34', during which time the bolt chambers a new cartridge in the barrel.

The gun can be operated in a full automatic mode by depressing a control member 34 to push it in a direction towards the gun frame. Such depression of the member 34 causes a secondary sear 36 to be connected to the primary sear 28 so they pivot together about a sear axis 38. During semiautomatic operation, the secondary sear 36 is free to pivot about the axis 38 without moving the primary sear 28. Every time the bolt 20 moves forward, a cam 40 on the bolt rides across the secondary sear 36 and depresses it to pivot it down, although this causes no effect in the semiautomatic mode. However, when the member 34 is depressed to connect the two sears together for automatic operation, then every time the bolt moves forward and the cam 40 thereon depresses the secondary sear 36, the primary sear 28 is depressed to release the firing device 22 to fire the chambered cartridge. It is noted that at the time the cam 40 depresses the secondary sear 36, the primary sear 28 is already abutting the extension 30 of the firing device, so that a brief temporary depression of the primary sear 28 releases the firing device to fire the cartridge. It is also noted that the masses of the bolt and firing pin devices, and the forces exerted by their respective springs, are chosen to assure that the bolt has moved to its full forward position before the firing pin catches up with it to fire a cartridge.

Figure 3:
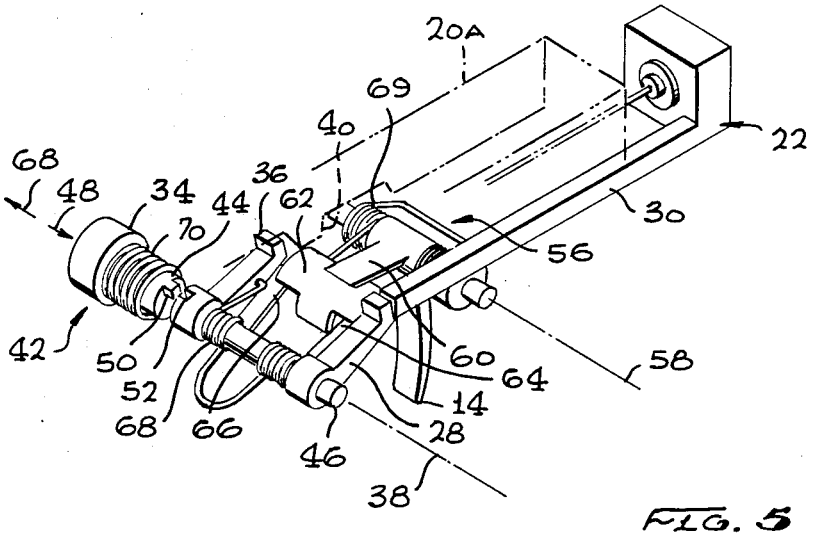
FIG. 3 is a partial perspective view of the firearm of FIG. 1, showing the trigger assembly and auto control thereof.
Figure 5:
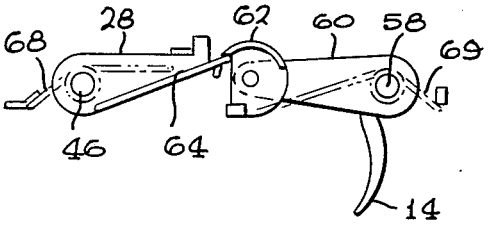
FIG. 5 is a partial side elevation view of the mechanism of FIG. 3.

FIG. 3 illustrates some of the details of operation of the auto control mechanism 42 which includes the control member 34. This auto mechanism 42 includes a connector 44 that is rotatable fixed to a sear shaft 46, but which can slide axially relative to the shaft, as by using a spline connection or sliding pin connection between them. The primary sear 28 is fixed to the shaft 46. When the control member 34 is pushed inwardly in the direction of arrow 48, a tooth 50 on the connector engages a tooth 52 on the secondary sear 36 (the tooth is one side of a recess), so the secondary sear 36 and the connector 44 are connected to pivot together, and therefore the two sears 36, 28 pivot together. When the bolt is at the position 20A, near its rearward position but moving forwardly, the primary sear 28 will have already engaged the firing device extension 30. The cam 40 on the bolt will then be approaching the secondary sear 36 and will depress it. If the control member 34 has been depressed so the connector 44 is connected to the secondary sear 36, then depression of the secondary sear 36 will cause depression of the primary sear 28 to release the firing device 22. Thus, the firing pin device will be released every time the bolt moves forward, so the gun will fire in a full automatic mode.

The trigger assembly 56 includes the trigger 14 which pivots about an axis 58 and which has a bar 60 extending forwardly. The trigger assembly also includes a sear horn 62 that engages ledges 64, 66 on the sears to depress them as the trigger is pulled and passes a middle position, and to then release the sears to extend up again as the trigger reaches a full rearward position. Although it is not necessary to depress the secondary sear, it is desirable to do so to move it out of the way of the bolt cam to minimize wear. A sear spring 68 urges both sears towards their extended positions, while a trigger spring 69 urges the horn up and the trigger forward.

As described above, when the auto control member 34 is depressed, the two sears 36, 28 pivot together and the gun operates in a full automatic mode. If the control member 34 is released, it will spring away from the frame in the direction of arrow 68' by a spring 70. Then the connector 44 will no longer engage the secondary sear, and the gun will stop operating in the auto mode. Even if such release of the control member 34 occurs at a time when the trigger 14 remains pulled to its rearward position, the gun will stop firing. This is because with the control member released, subsequent depression of the secondary sear 36 by the bolt will not cause depression of the primary sear 28, and therefore the primary sear 28 will engage the extension 30 the next time the bolt has pushed back the firing pin device. This is of considerable importance, because during full automatic operation, there is a possibility that the machine gun will begin climbing out of control of the operator. The operator then may release the control member 34, but may forget to release the trigger 14. The fact that full automatic operation stops when the control member 34 is released, avoids continuing firing of the gun.

When the machine gun is used in the full automatic mode the secondary sear 36 is subjected to repeated blows from the cam 40 on the bolt. If the secondary sear 36 should break, the firearm is not totally disabled, but can still be fired in the semiautomatic mode, since such firing depends only upon operation of the primary sear 28.

Figure 2:
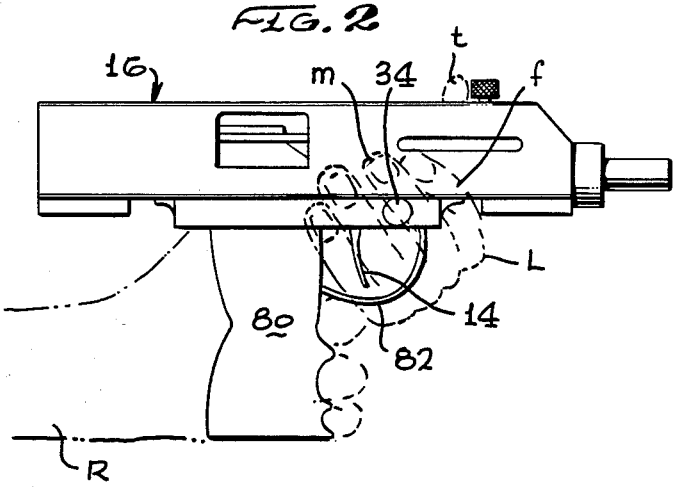
FIG. 2 is a right side elevation view of the firearm of FIG. 1, showing how it is held and operated.

The control member 34 is positioned and operated in a manner that facilitates secure handling of the firearm and good control of the auto mechanism. The firearm has a hand grip 80 (FIG. 2) lying behind the trigger 14, and the firearm can be operated by a righthanded person who grasps the hand grip 80 in his right hand R and with his forefinger on the trigger 14. For more secure holding of the gun, which is especially important in the full automatic mode, the operator also uses his left hand L to hold the firearm, by holding the gun frame 16 nested in his left hand between the thumb t and forefinger f of that hand. The left hand wraps about some of the fingers of the right hand, as well as a portion of the frame that lies immediately forward of the trigger guard 82. All of the fingers of the left hand except the thumb lie on the right side of the frame. In this position, the operator can easily feel the control member 34 as with his middle finger m, and can easily depress the control member when it is desired to switch to the full automatic mode, or release the member to switch back to the semiautomatic mode. Thus, by placing the control member 34 on the right side of the gun at a location forward of the trigger 14, the member can be easily sensed by the fingers of the left hand that also hold the gun, and the fingers can then easily depress and release the control member.

The use of a control 34 that switches to a full automatic mode and back to a semiautomatic mode, by respectively depressing and releasing the member, facilitates reliable operation of the device. Where, instead, a selector switch is used that must be moved forward and rearward, or up and down, there is a considerable likelihood of confusion on the part of the operator as to the current position of the member and the direction in which it must be moved. Where the member must be depressed for the full automatic mode and released for the semiautomatic mode, there is much less chance for confusion. It is easy for the operator to remember that if no pressure is applied to the control member 34, that it remains in the semiautomatic mode, and that a considerable depressing force such as ten pounds must be applied to switch to full automatic. The operator also knows whether or not the control member is in the full automatic mode, because he merely has to sense whether he is applying a full force or not. The ability to feel the control member 34 with his left hand, to know that switching to full automatic is accomplished by depressing the member, and to switch to the semiautomatic mode by releasing the member 34, all facilitate proper operation of the firearm under difficult conditions such as in the heat of battle.

Figure 6:
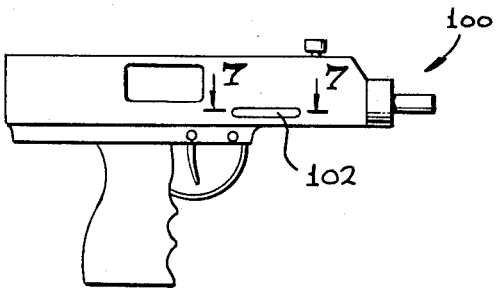
FIG. 6 is a right side elevation view of a firearm constructed in accordance with another embodiment of the invention.
Figure 7:
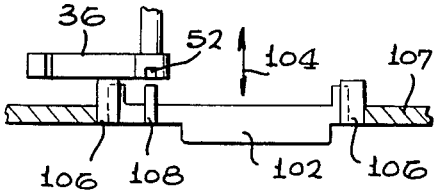
FIG. 7 is a view taken on the line 7—7 of FIG. 5.
Figure 4:
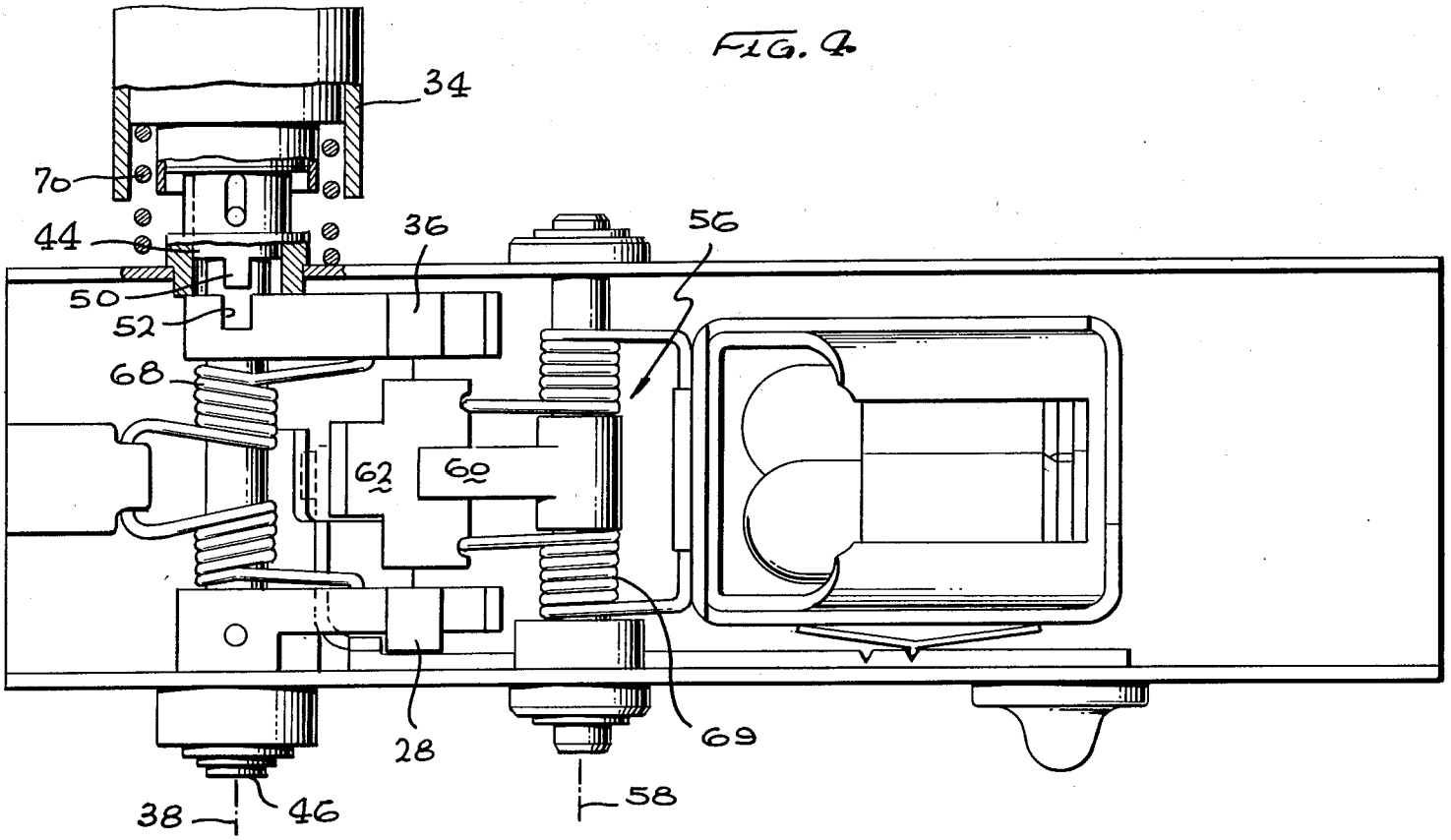
FIG. 4 is a more complete plan view of the mechanism of FIG. 3.
Figure 8:
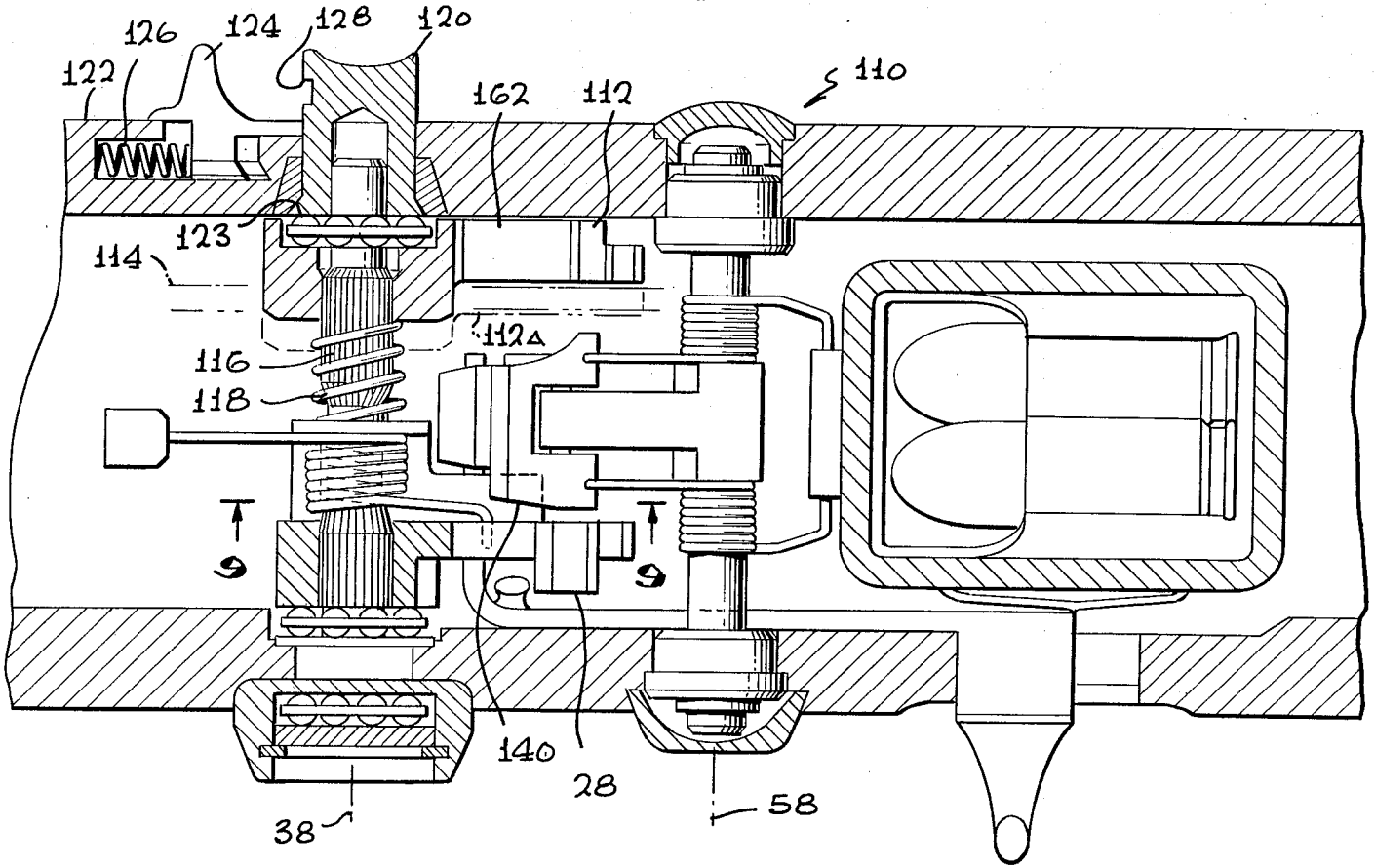
FIG. 8 is a partial plan view of a firearm constructed in accordance with another embodiment of the invention.

FIGS. 6 and 7 show another firearm 100 which is similar to that of FIG. 1, except that a control member 102 is used which is of elongated form with its length parallel to the length direction of the gun, to facilitate feeling and operation of the member by the operator of the weapon. The control member 102 is guided in sliding along the direction of arrows 104 by a pair of guides 106, so the member can be depressed into the frame 107 or released to move outwardly therefrom. A tooth 108 is mounted on the member to engage a corresponding tooth 52 on the secondary sear 36, so the mechanism operates in a manner similar to that of FIG. 3.

FIGS. 8–11 illustrate another firearm 110 which is somewhat similar to that of FIG. 1. One important difference is that in semiautomatic operation the secondary sear 112 lies away from the path 114 of the bolt cam (40 in FIG. 3). Switching to full automatic operation involves sliding the secondary sear to position 112A in which the secondary sear lies in the path of the bolt cam. The secondary sear is pivota11y connected to the primary sear 28 through a splined shaft 116 so the sears pivot together about the sear axis 38, and yet the secondary sear 112 can slide between the positions 112 and 112A. A control spring 118 urges the secondary sear towards its semiauto position 112. A control member 120 in the form of a button extending from a side of the gun frame 122, can be depressed by fingers of the person operating the firearm to move the secondary sear to the full auto position at 112A. The control member 120 is connected through a bearing 123 to an end of the splined shaft 116. Thus, the weapon is switched to the full auto mode wherein the primary sear 28 is depressed at every depression of the secondary sear 112 by the bolt, not by pivotally connecting previously unconnected sears, but by moving the secondary sear from a position out of the path of the bolt cam into the path of the cam. It would be possible to also make an initial pivotal connection between the two sears during such movement, but this is not necessary.

A retainer 124 which is urged towards the control member 120 by a retainer spring 126, enters a slot 128 in the control member to retain it in the full auto position when it has been depressed to that position. The control member can be released to the semiauto position by a person pushing forward on the retainer 124. Thus, when the control member 120 is depressed, the gun can continue to fire in a full automatic mode even if the operator stops pushing in on the control member. Instead, firing of the weapon is then controlled by operation of the trigger.

The trigger mechanism is constructed so that when the control member 120 is depressed to the full automatic mode, release of the trigger stops firing of the weapon, and pulling of the trigger causes firing again in the full automatic mode.

Figure 9:
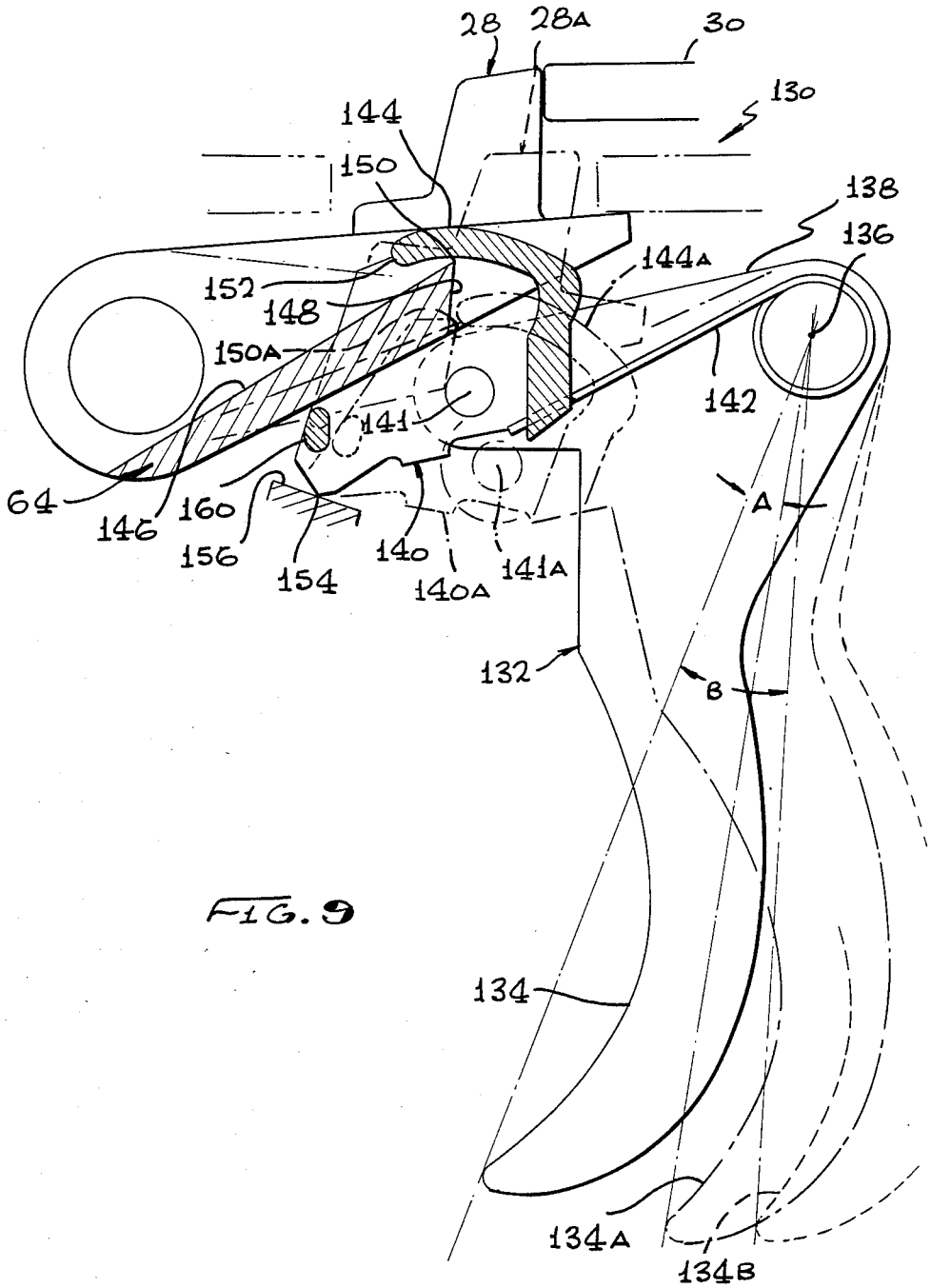
FIG. 9 is a partial side view showing in cross-sectional hatching some of the mechanism seen in the view 9—9 of FIG. 8, and also showing other portions of the mechanism.

FIG. 9 shows details of the trigger mechanism 130, this drawing showing, in solid lines, the trigger 132 with its finger-engaging arm 134 in the forward position. In the forward position, the mechanism holds the primary sear 28 in its upward or deployed position in which it holds the firing pin device 30 to prevent its forward movement. The trigger 132 is pivotally mounted about a trigger axis 136 on the gun frame, and has a largely horizontal horn-engaging arm 138. A horn 140 is pivotally mounted about a horn axis 141 on the end of the horn-engaging arm. A horn spring 142 urges the horn to move upward and to pivot counterclockwise (as seen in FIG. 9). The horn has a horn cam 144 that lies over the upper surface 146 of the ledge portion 64 of the primary sear. The ledge of the primary sear also has a largely vertical rear surface 148 that meets the upper surface at a corner 150.

When the finger-engaging trigger arm 134 is pulled rearwardly to the release position indicated at 134A, which is at an angle A of 12° from the forward position of the arm, the horn cam 144 moves down and rearwardly to the release position 144A. In moving down, the horn depresses the ledge 64 of the primary sear until its corner moves to the position 150A at which the end 152 of the horn cam disengages the corner 150A of the sear ledge. The sear then springs up from the depressed position 28A to its deployed position 28. During such downward and rearward movement of the horn cam 150, the horn 140 has pivoted about its lower tip 154 on a pivot surface 156 on the gun frame. The horn axis is then at 141A.

The finger-engaging trigger arm 134 can be pulled to an extreme rearward position 134B at which it is at an angle B of 18° from the forward trigger position. As shown in FIG. 10, the horn is then in the position 140B. When the finger-engaging trigger arm is then released to move forward, the horn cam at 144B moves forward and upward until it encounters the vertical wall 148 of the sear ledge 64. The front 152 of the horn cam slides up along the vertical wall 148 until it reaches the corner 150, and then moves forward to its original position at 140. During the upward sliding of the horn cam at 140C, the tip of the horn at 154C lifts off the pivot surface 156 on which it can also pivot and slide. This trigger mechanism, which is useful in other devices, automatically releases the sear to move up immediately after depressing the sear.

The horn 140 includes a stop 160 (FIG. 9) which lies closely under the primary sear when the trigger is forward. The stop 160 prevents the primary sear from being depressed, even if the bolt is moving forward and its cam is then striking the secondary sear to try to depress it. Thus, although the firearm is in the full automatic mode (by reason of the control member 120 being depressed) the trigger still controls firing, and release of the trigger so it moves forward will result in cessation of firing.

The connection between the secondary and primary sears can be made moderately resilient. The resilience is sufficient that when the trigger is forward so that the stop 160 prevents the primary sear from being depressed, the secondary sear can still be depressed by the bolt. This allows the bolt to move forward to its closed position. However, the connection between the two sears is stiff enough so that when the stop 160 is out of the way (because the trigger is pulled), the primary sear 28 will be depressed every time the secondary sear is depressed. Thus, when the control member is depressed to the full automatic mode, the trigger controls firing, and yet the weapon always stops in a closed-bolt condition.

A moderately resilient pivotal connection between the two sears 112, 28 can be achieved by various constructions, as by constructing the arm 162 (FIG. 8) of the secondary sear so it can resiliently bend, or by constructing the sear shaft 116 so it has moderate torsional resilience. FIG. 11 shows that the sear shaft 116 is hollow and has a slit 170 that forms a portion of the shaft into a coil spring to connect the sears. It should be noted that the pivotal connection between the sears can be made rigid, but then a forward moving bolt will be stopped by the secondary sear and the bolt will remain open.

Thus, the invention provides a repeating firearm that facilitates operation and which is highly reliable. The firearm includes a manually operated control member for switching between full and semiautomatic operation, which is manually depressed towards the frame of the gun to switch to the full automatic operation. The control member is located on the right side of the gun frame forward of the trigger, at a position wherein a person holding the hand grip and trigger in the right hand and the gun portion immediately forward thereof in the left hand and with the gun craddled between the thumb and forefinger of the left hand, can feel the control member and easily depress it and release it. The gun includes a trigger assembly with a trigger that can be pulled rearwardly so at a middle location along the trigger path a primary sear is released to release the firing pin device, and with the sear returning to its extended position when the trigger is pulled to the full rearward position. A secondary sear which can lie in the path of the bolt so it is depressed when the bolt moves forward, can be coupled to the primary sear to retract them together, the secondary sear both lying in the path of the bolt and coupled to the primary sear, only when the auto control member is depressed.

Although particular embodiments of the invention have been described and illustrated herein, it is recognized that modifications and variations may readily occur to those skilled in the art and consequently, it is intended that the claims be interpreted to cover such modifications and equivalents.

We claim:

1. In a repeating firearm which includes a bolt and firing pin device that can independently slide forward and rearward within a gun frame that holds a barrel, and which also includes a trigger mechanism that can depress a primary sear to release the firing pin device held by the primary sear, the improvement of an auto control for enabling full automatic operation comprising:

a secondary sear which can be depressed by said bolt as said bolt moves forward; and mode control means including a manually moveable control member moveable between full auto and semiauto positions, and also including means responsive to the position of said control member, for urging depression of said primary sear at each forward movement of said bolt in the full auto position of said control member, and for refraining from urging depression of said primary sear at each forward movement of said bolt in the semiauto position of said control member, said mode control means coupling said secondary sear to said primary sear at least in the full auto position of said control member so the primary sear can then be depressed by depression of the secondary sear by said bolt;

said trigger mechanism includes a trigger which can be pulled and means connecting said trigger to said primary sear to depress said primary sear each time said trigger is pulled;

said trigger mechanism also including a stop which lies in the path of depression of said primary sear to prevent its depression when said trigger is not pulled, said stop lying out of the path of depression of said primary sear when said trigger is pulled, whereby even in the full auto position of the manually moveable member release of the trigger stops the firearm from firing.

2. In a repeating firearm which includes a bolt and firing pin device that can independently slide forward and rearward within a gun frame that holds a barrel, and which also includes a trigger mechanism that can depress a primary sear to release the firing pin device held by the primary sear, the improvement of an auto control for enabling full automatic operation comprising:

a secondary sear which can be depressed by said bolt as said bolt moves forward; and mode control means including a manually moveable control member moveable between full auto and semiauto positions, and also including means responsive to the position of said control member, for urging depression of said primary sear at each forward movement of said bolt in the full auto position of said control member, and for refraining from urging depression of said primary sear at each forward movement of said bolt in the semiauto position of said control member, said mode control means coupling said secondary sear to said primary sear at least in the full auto position of said control member so the primary sear can then be depressed by depression of the secondary sear by said bolt said manually moveable control member includes a push button lying at a side of said gun frame and depressable in a direction into the gun frame to said full auto position, a button spring urging said button out of said frame, a retainer moveable on said frame to a retain position at which it holds said button in a depressed position, and a retainer spring urging said retainer toward said retain position;

said retainer having a handle that can be engaged by the hand of an operator to move the retainer away from said retain position so that button can automatically spring out, whereby the firearm can be locked in its full auto mode by merely depressing a button and leaving it depressed.

3. In a repeating firearm which includes a bolt and firing pin device that can independently slide forward and rearward within a gun frame that holds a barrel, and which also includes a trigger mechanism that can depress a primary sear to release the firing pin device held by the primary sear, the improvement of an auto control for enabling full automatic operation comprising:

a secondary sear which can be depressed by said bolt as said bolt moves forward; and mode control means including a manually moveable control member moveable between full auto and semiauto positions, and also including means responsive to the position of said control member, for urging depression of said primary sear at each forward movement of said bolt in the full auto position of said control member, and for refraining from urging depression of said primary sear at each forward movement of said bolt in the semiauto position of said control member, said mode control means coupling said secondary sear to said primary sear at least in the full auto position of said control member so the primary sear can then be depressed by depression of the secondary sear by said bolt;

said firearm includes a sear shaft that is rotatably mounted on said gun frame about a sear axis extending perpendicular to the direction of movement of said bolt, said primary and second sears both pivotally mounted about said sear axis;

said primary sear is fixed to said shaft while said secondary sear is rotatably fixed to said shaft but is axially slideable thereon;

said manually moveable control member is moveable along said sear axis between an inward position at which it holds said secondary sear in the path of said bolt cam to be depressed by it, and an outward position at which it allows said secondary sear to move out of the path of said bolt cam, said inward and outward positions being the full auto and semiauto positons of said member.

4. In a repeating firearm which includes a bolt and firing pin device that can independently slide forward and rearward within a gun frame that holds a barrel, and which also includes a trigger mechanism that can depress a primary sear to release the firing pin device held by the primary sear, the improvement of an auto control for enabling full automatic operation comprising:

a secondary sear which can be depressed by said bolt as said bolt moves forward; and mode control means including a manually moveable control member moveable between full auto and semiauto positions, and also including means responsive to the position of said control member, for urging depression of said primary sear at each forward movement of said bolt in the full auto position of said control member, and for refraining from urging depression of said primary sear at each forward movement of said bolt in the semiauto position of said control member, said mode control means coupling said secondary sear to said primary sear at least in the full auto position of said control member so the primary sear can then be depressed by depression of the secondary sear by said bolt;

said trigger mechanism includes a trigger pivotally mounted on said gun frame said trigger having a finger-engaging arm which can be pulled by a person's finger and having a horn arm, a horn pivotally mounted on the end of said horn arm, and a horn spring which urges said horn arm and said horn in at least a partially upward direction, said horn having a tip which can pivot on said pivot surface and move off said surface;

said primary sear has a ledge with an upper surface and a primarily vertical rearward surface that form a corner where they meet, said horn having a cam lying over and forward of said corner to depress said sear as said finter-engaging arm is moved rearwardly by up to a predetermined angle from an extreme forward position, said horn cam being short enough that it passes behind said corner and releases said primary sear to move back to its undepressed position when said trigger pivots beyond said predetermined angle;

said horn spring urging said horn to pivot in a direction to move the front of said horn cam forward, so as said horn rises the front of said horn cam slides up along said vertical rearward surface of said sear ledge until the front of said cam reaches said corner, at which time said cam front moves forward to lie over said ledge upper surface.

5. A repeating firearm, comprising:

a gun frame with front and rear ends;

a gun barrel mounted on said frame;

a bolt moveable in predetermined longitudinal directions in said frame, including a forward longitudinal direction to chamber a cartridge at the rear of the barrel, and a rearward direction, said bolt having a bolt cam that moves along a predetermined path as said bolt moves forward;

a firing pin device moveable forwardly in said frame independently of said bolt to fire a chambered cartridge, and moveable rearwardly;

a trigger mounted on said frame and moveable by a person from a forward position to a rearward position;

a primary sear which can prevent forward movement of said firing pin device and which can be depressed to release said firing pin device to move forward, said trigger coupled to said primary sear to depress it when the trigger is moved to said rearward position;

a secondary sear;

a manually operable member that can move between full auto and semiauto positions, said member coupled to said secondary sear to move it into the path of said bolt cam when the member is moved to said full auto position, so that during forward movement of said bolt said bolt cam can depress said secondary sear, and to move said secondary sear out of the path of said bolt cam when the member is moved to said semiauto position; and means for pivotally connecting said secondary and primary sears at least when said secondary sear lies in the path of said bolt cam, to urge depression of said primary sear when said secondary sear is depressed.

6. The firearm described in claim 5 including:

a spring which moves said trigger to a forward position when it is released and a stop positioned in the path of depression of said primary sear to prevent its depression when said trigger is in its forward position.

7. The firearm described in claim 5 including:

stop means responsive to the position of said trigger for preventing depression of the primary sear when the trigger is in said forward position; and wherein said means for pivotally connecting said sears has a moderate resilience which is great enough to allow the secondary sear to be depressed by said bolt cam even when the primary sear is prevented from being depressed, but said resilience being small enough to assure depression of the primary sear at every depression of the secondary sear when said stop means for preventing depression does not prevent depression of the primary sear.

8. In a gun having a trigger mechanism mounted on a gun frame for releasing a firing pin device the improvement wherein:

said gun frame has a pivot surface;

said trigger mechanism includes a trigger pivotally mounted on said gun frame said trigger having a finger-engaging arm which can be pulled by a person's finger and having a horn arm, a horn pivotally mounted on the end of said horn arm, and a horn spring which urges said horn arm and said horn in at least a partially upward direction, said horn having a tip which can pivot on said pivot surface and move off said surface;

said primary sear has a ledge with an upper surface and a primarily vertical rearward surface that form a corner where they meet, said horn having a cam lying over and forward of said corner to depress said sear as said finger-engaging arm is moved rearwardly by up to a predetermined angle from an extreme forward position, said horn cam being short enough that it passes behind said corner and releases said primary sear to move back to its undepressed position when said trigger pivots beyond said predetermined angle;

said horn spring urging said horn to pivot in a direction to move the front of said horn cam forward as well as upward, so as said horn rises the front of said horn cam slides up along said vertical rearward surface of said sear ledge until the front of said cam reaches said corner, at which time said cam front moves forward to lie over said ledge upper surface.

* * * * *